US007238031B2

(12) United States Patent
Takai

(10) Patent No.: US 7,238,031 B2
(45) Date of Patent: Jul. 3, 2007

(54) CONTACT STRUCTURE AND MANUFACTURING METHOD THEREOF, AND ELECTRONIC MEMBER TO WHICH THE CONTACT STRUCTURE IS ATTACHED AND MANUFACTURING METHOD THEREOF

(75) Inventor: Daisuke Takai, San Jose, CA (US)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/057,699

(22) Filed: Feb. 14, 2005

(65) Prior Publication Data

US 2006/0183365 A1 Aug. 17, 2006

(51) Int. Cl.
*H01R 12/00* (2006.01)

(52) U.S. Cl. ..... 439/66

(58) Field of Classification Search ..... 439/66, 439/81, 71; 361/774, 773, 776
See application file for complete search history.

(56) References Cited

U.S. PATENT DOCUMENTS 5,398,863 A 3/1995 Grube et al.
5,615,824 A 4/1997 Fjelstad et al.
6,174,172 B1 * 1/2001 Kazama ..... 439/66
6,722,893 B2 * 4/2004 Li et al. ..... 439/66
6,781,390 B2 * 8/2004 Kazama ..... 324/754
6,827,584 B2 * 12/2004 Mathieu et al. ..... 439/66
6,856,225 B1 2/2005 Chua
6,913,468 B2 * 7/2005 Dozier et al. ..... 439/66
6,994,565 B2 * 2/2006 Harper, Jr. ..... 439/66

* cited by examiner

*Primary Examiner*—Phuong Dinh
(74) *Attorney, Agent, or Firm*—Brinks Hofer Gilson & Lione

(57) ABSTRACT

A contact structure for electroconductively connecting between an electronic part and a board includes a contact member, which is provided between the electronic part and the board, having a leg portion for electroconductively connecting between the electronic part and the board. The leg portion of the contact member can be bent and deformed in a simple and reliable manner by utilizing internal stress even if the contact member is formed very fine corresponding to forming the electronic part very fine, and thus, the leg portion of the contact member can appropriately serve as an elastic contact member The contact member can absorb distortion due to thermal expansion coefficient differences between the electronic part and the board, thereby ensuring electroconductive connection between the electronic part and the board.

5 Claims, 8 Drawing Sheets

CONTACT STRUCTURE AND MANUFACTURING METHOD THEREOF, AND ELECTRONIC MEMBER TO WHICH THE CONTACT STRUCTURE IS ATTACHED AND MANUFACTURING METHOD THEREOF

BACKGROUND OF THE INVENTION

1. Field of the Invention

The present invention relates to a contact structure to be attached to an electronic member such as an IC for example, and more specifically relates to a contact structure capable of electroconductively connecting between electronic members in an excellent manner even in the event of reduction in size of electronic members to very small sizes, and the manufacturing method thereof.

2. Description of the Related Art

A configuration has been conceived for electroconductively connecting an IC or the like on a board in the event that there are great differences between the thermal expansion coefficients of both electronic members, wherein a spring member with a spring-like shape or the like is provided underneath of the terminals of the IC to appropriately absorb distortion caused due to the thermal expansion coefficient differences, for example.

Now, the spring member needs to be reduced in size so as to match the size of the electronic member, and particularly, the more ultra-fine the electronic member is, the more the spring member itself needs to be made extremely small. At this time, the smaller the spring member is, the more difficult it is to form the spring member in a three-dimensional manner such as a spring-like shape. In addition, unless the spring member has a certain level of elastic force, the distortion due to the thermal expansion coefficient differences cannot be appropriately absorbed using the spring member.

The invention regarding the manufacturing method of a thin-film structure is disclosed in Japanese Patent No. 3,099,066. Of the several manufacturing methods disclosed, a thin-film structure wherein a thin-film is caused to curve by utilizing internal stress is disclosed (see claim 5 and description of FIGS. 17 through 22).

However, Japanese Patent No. 3,099,066 neither mentions nor suggests employing the thin-film structure as a contact structure between electronic members. Similarly, with Japanese Patent No. 3,366,405, the manufacturing method of an ultra-fine structure to be formed with metal is described, but there is no description of employing the ultra-fine structure as a contact structure, and also the ultra-fine structure is not formed in a three-dimensional manner such as in a spring shape.

SUMMARY OF THE INVENTION

Accordingly, the present invention has been made in light of solving the aforementioned conventional problems, and relates to a contact structure to be attached to an electronic member such as an IC for example, and it is an object of the present invention to provide a contact structure capable of electroconductively connecting between electronic members in a good condition even in the event of electronic members being formed very fine, the manufacturing method thereof, an electronic member to which the contact structure is attached, and the manufacturing method thereof.

With the present invention, in a contact structure for electroconductively connecting between electronic members, a contact member comprises: a fixed portion to be fixed to one of the electronic members; and a leg portion for electroconductively connecting between the electronic members, wherein the leg portion is deformed from a contact surface with the electronic member of the fixed portion in the surface direction of the opposite side of the contact surface.

According to the present invention, the contact member is configured of a fixed portion and a contact portion, and the fixed portion is used for bonding an to electronic member. On the other hand, the contact member can be appropriately attached to the electronic member even if the of the electronic member is formed very fine, by the leg portion being deformed in the surface direction of the opposite side of a contact surface with the electronic member of the fixed portion, and also the leg portion can be employed as an elastic contact point between the electronic members. Also, distortion due to the thermal expansion coefficient differences of electronic members can be appropriately absorbed, thereby electroconductively connecting between the electronic members in a reliable manner.

According to the present invention, it is preferable that a sheet member is provided on the opposite side of the contact surface with the electronic member of the fixed portion, a through hole is provided in the sheet member, and part of the leg portion extends in the through hole. According to the aforementioned configuration, the sheet member intervenes between the electronic member on the side being in contact with the leg portion and the contact member, whereby only part of the leg portion is appropriately in contact with a predetermined position of the electronic member. Consequently, the present invention can provide a contact structure having a high-reliable contact point. With the present invention, the tip of the leg portion preferably protrudes from the through hole.

According to the present invention, the amount-of-protrusion $\delta$ from the through hole of the leg portion is set such that stress necessary for deforming the tip of the leg portion to the same surface as the surface facing the other of the electronic member of the sheet member is smaller than the yield point. Thus, the leg portion suitably acts as an elastic contact point.

According to the present invention, the contact member is preferably made up of a thin film, thereby facilitating forming the contact structure even finer.

According to the present invention, a sacrifice layer is preferably provided between the sheet member and the fixed portion. Thus, the fixed portion can be appropriately bonded on the sheet member.

According to the present invention, the leg portion of the contact member preferably has a shape protruding in the manner of a cantilever or in a helical manner. Thus, electroconductive connection between the electronic members can be performed in a reliable manner.

According to the present invention, leg portion is preferably heat-treated, thereby deformed from a contact surface with said electronic member of said fixed portion in the surface direction of the opposite side of said contact surface.

According to the present invention, the fixed portion of the contact member and the electronic member are preferably bonded by ultrasonic welding, cold welding or electrically conductive adhesive. Thus, the fixed portion and the electronic member can be firmly bonded.

Also, the electronic member according to the present invention is attached to any one of the aforementioned contact structures.

According to the present invention, the contact structure includes a fixed portion, and the contact structure can be readily appropriately attached to a predetermined position of an electronic member from the contact surface of the fixed portion.

The present invention has the following processes in a manufacturing method of a contact structure for electroconductively connecting between electronic members:

(a) a process for forming a flat-shaped contact member on a sheet member;

(b) a process for forming a through hole in at least a position facing part of the leg portion of the contact member of the sheet member prior to the process (a) or following the process (a); and (c) a process for deforming part of the leg portion of the contact member in the inner direction of the through hole.

According to the present invention, the aforementioned processes allow a contact structure to be manufactured readily. According to the conventional arrangement, a contact portion and a base have been independently formed, and the multiple contact portions have had to be bonded on the base one by one, so high positioning accuracy has been demanded at the time of bonding the contact portions on the base. However, according to the present invention, even in the event that multiple contact members are provided, these contact members can be formed simultaneously on the sheet member, so the contact members can be positioned with high accuracy as compared to the conventional arrangement, and also the multiple contact members can be formed simultaneously, and accordingly, the present invention is more effective than the conventional arrangement.

Also, according to the present invention, it is preferable that in the process (a), a sacrifice layer and a contact member are formed on the sheet member, and different internal stress is applied to the under surface and top surface of the contact member, and in the process (c), the sacrifice layer provided on the lower side of the leg portion is removed, thereby bending and deforming part of the leg portion in the inner direction of the through hole.

According to the present invention, passing through the aforementioned processes allows the leg portion of the contact member to be bent and deformed even if the contact member is formed very fine in accordance with of the electronic member being formed fine.

Also, according to the present invention, in the process (a), compressive stress is preferably applied to the under surface side of the contact member, and tensile stress to the top surface side thereof. Thus, in the process (c), in the event that the sacrifice layer provided on the lower side of the leg portion is removed, the leg portion can be appropriately bent in the direction of the through hole. Also, according to the present invention, it is preferable that the contact member is formed by sputter vapor deposition, and at this time, the internal stress of the contact member is controlled by changing vacuum gas pressure. Thus, the internal stress of the contact member can be controlled by a simple technique.

Also, according to the present invention, it is preferable that during the process (b) through process (c), a mask layer is formed on the fixed portion of the contact member, and the sacrifice layer on the lower side of the leg portion of the contact member, which is not covered with the mask layer in the process (c), is removed.

Also, according to the present invention, an arrangement may be made wherein during in process (a), the contact member having a cantilever-shaped or a helical-shaped leg portion is formed in a flat shape, and during the process (c) the cantilever-shaped or helical-shaped leg portion is protruded and deformed in the direction of the through hole provided in the sheet member. Thus, a contact member having a helical-shaped leg portion can be formed by a simple technique.

Also, according to the present invention, in the process (a), the sheet member is adhered on a base in which a through hole is formed beforehand, and in the process (b), a through hole is formed from the through hole of the base to the sheet member. Thus, through holes can be easily formed in the sheet member, and each of the processes can be performed with high accuracy.

According to the present invention, it is preferable that (d) a process for plating a metal film for covering the surface of the contact member is performed during the process (b) through process (c), or following the process (c). Forming the metal film allows electroconductive deterioration of the contact member to be suppressed and so forth in an appropriate manner.

According to the present invention, with a manufacturing method of an electronic member to which the contact structure is attached, the fixed portion of the contact structure formed according to any one of the aforementioned arrangements is bonded with the electronic member from the surface of the opposite side of the side to which the sheet member is attached.

In this case, the metal film formed in the process (d) is preferably bonded with the electronic member of the fixed portion as a bonding layer. Thus, both members can be readily bonded in a sure manner.

According to the present invention, the fixed portion is preferably bonded with the electronic member by ultrasonic welding, cold welding or electrically conductive adhesive. Thus, both members can be properly bonded.

According to the present invention, with a manufacturing method of a contact structure, during said process (c) the part of the leg portion of the contact member is preferably deformed in the inner direction of said through hole by heat treatment. Thus, the leg portion can be deformed by a simple technique.

DESCRIPTION OF THE PREFERRED EMBODIMENTS

Figure 1:
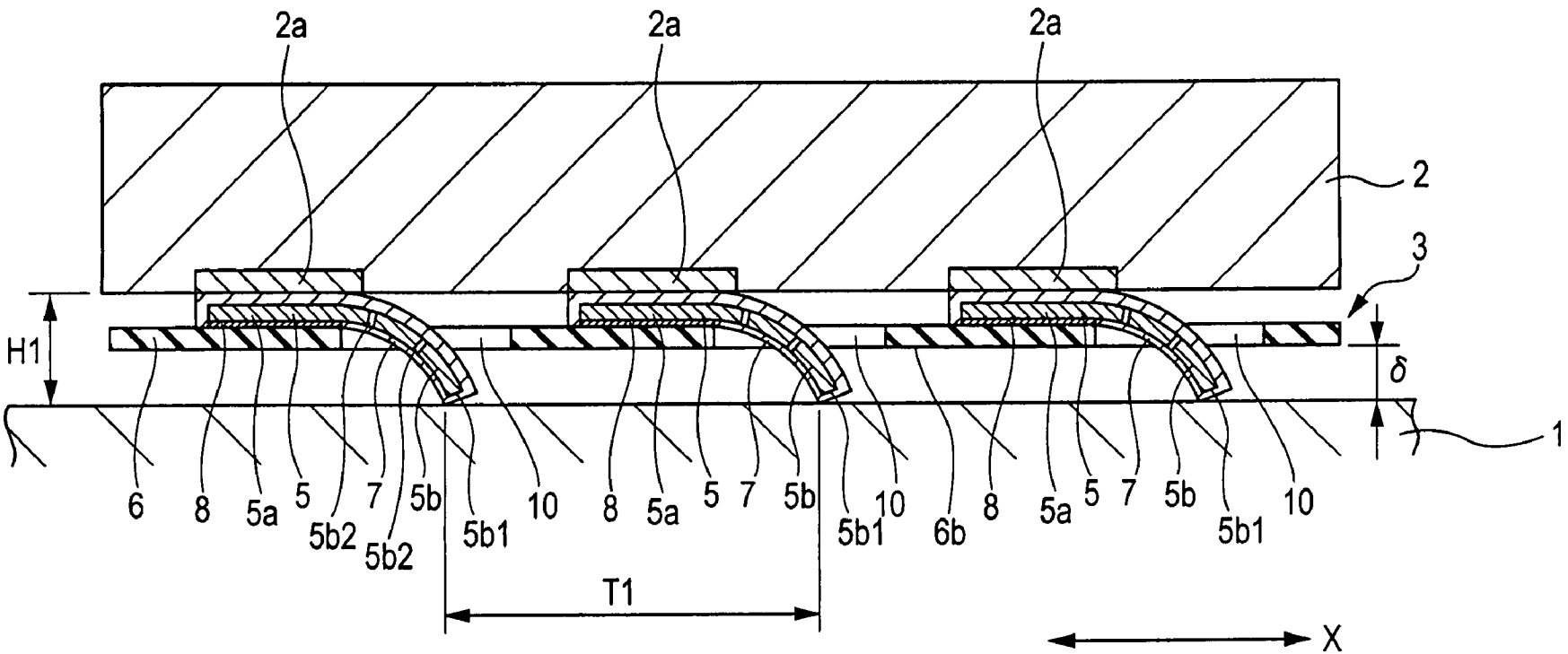
FIG. 1 is a partial cross-sectional diagram illustrating a board, electronic part, and contact structure according to a first embodiment of the present invention.
Figure 2:
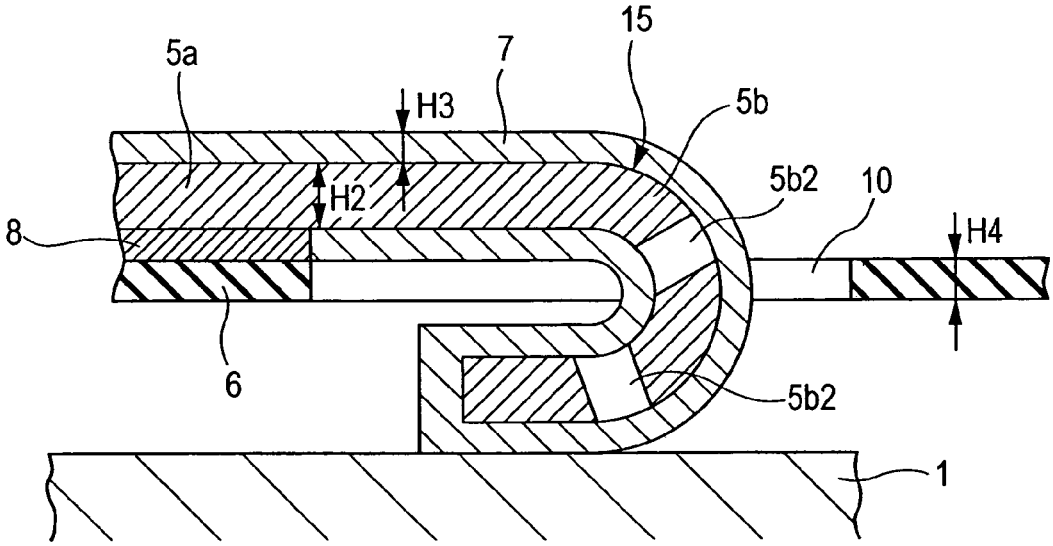
FIG. 2 is a partial cross-sectional diagram illustrating the contact structure shown in Fig.
Figure 3:
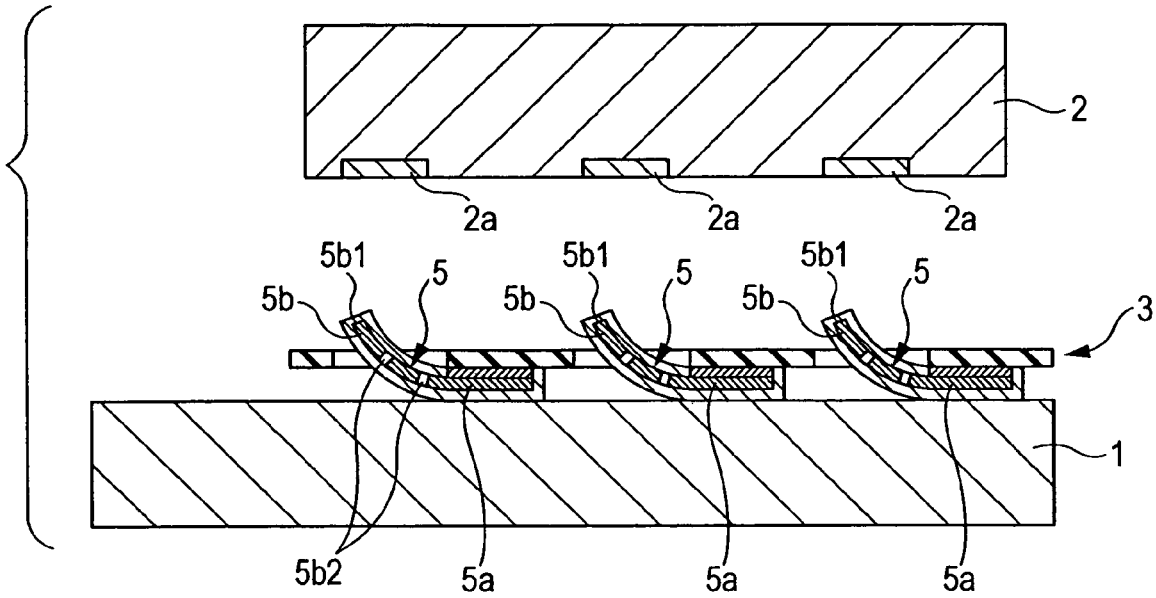
FIG. 3 is a partial cross-sectional diagram illustrating a board, electronic part, and contact structure according to a second embodiment of the present invention.
Figure 4:
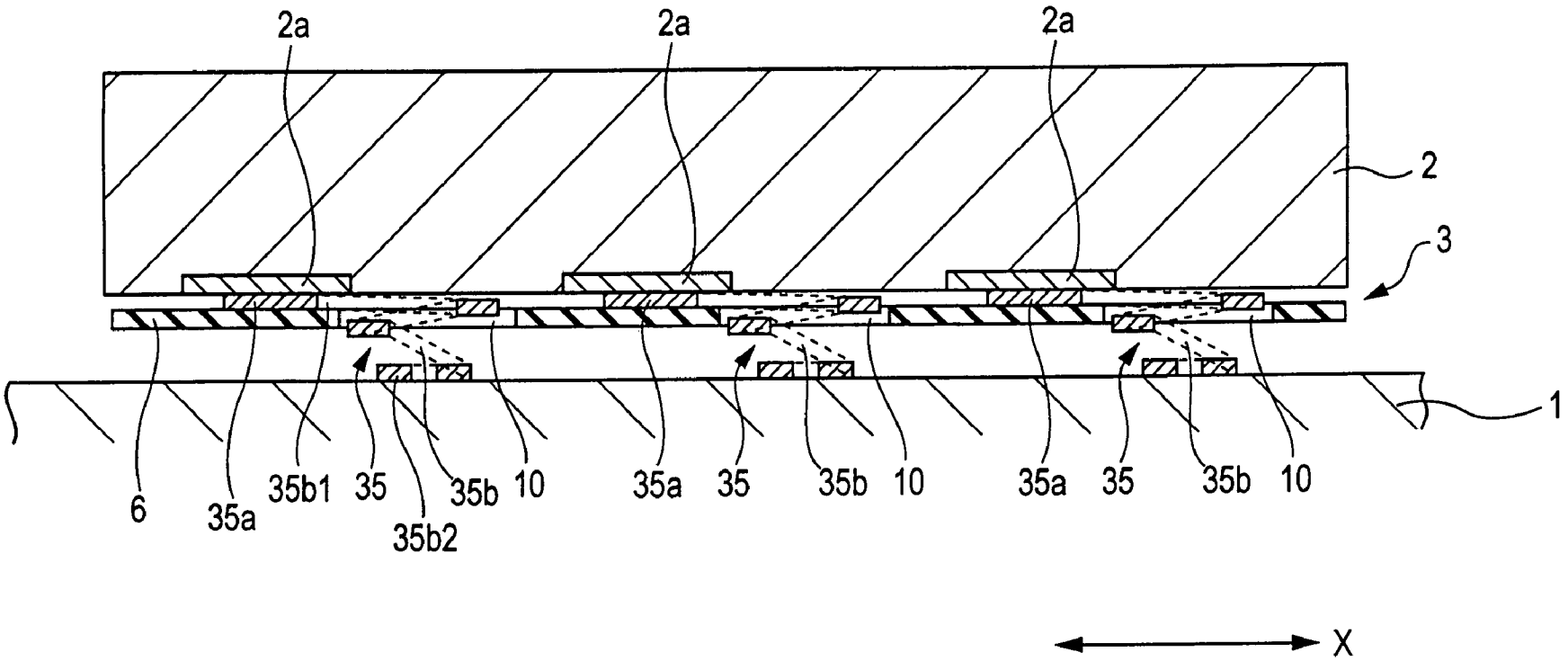
FIG. 4 is a partial cross-sectional diagram illustrating a board, electronic part, and contact structure according to a third embodiment of the present invention.

FIGS. 1 and 3 are partial cross-sectional diagrams illustrating a board, electronic part, and contact structure according to embodiments of the present invention, FIG. 2 is a partial enlarged cross-sectional diagram illustrating the contact structure shown in FIG. 1, and FIG. 4 is a partial cross-sectional diagram illustrating a board, electronic part, and contact structure according to a third embodiment of the present invention.

Note that hereinafter, the term "deformation" will be frequently used with regard to the leg portion of a contact member. In the present specification, the term "deformation" means a state distorted in the upper direction or in the lower direction as viewed from the fixed portion, in comparison with being in the same plane as the fixed portion of the contact member.

As illustrated in FIG. 1, an electronic part 2 is mounted on a board 1 made up of an insulating material. Examples of the electronic part 2 include ICs, capacitors, and transistors. Here, a terminal 2*a* made of Al or the like is formed on the under surface of the electronic part 2, for example. The terminal 2*a* is electroconductively connected to a wiring pattern (not shown) formed on the board 1 via a later-described contact structure 3.

As illustrated in FIG. 1, a contact structure 3 is provided on the lower side of the terminals 2*a*. The contact structure 3 is configured of contact members 5 and an insulating sheet member 6 made up of polyimide or the like. The contact member 5 is configured of a fixed portion 5*a* and a leg portion 5*b*, and the surface of the contact member 5 is covered with a metal film 7 made up of Au or the like except for the under surface of the fixed portion 5*a*. The metal film 7 is plated as described later, and the metal film 7 formed on the fixed portion 5*a* serves as a bonding layer as to the terminal 2*a* of the electronic part 2, and the top surface (bonding surface) of the fixed portion 5*a* of the contact member 5 and the terminal 2*a* are firmly bonded via the metal film 7 by means of ultrasonic welding, cold welding, electrically conductive adhesive or the like, for example.

As illustrated in FIG. 1, a sacrifice layer 8 is formed on the under surface of the fixed portion 5*a* of the contact member 5, and the fixed portion 5*a* and the sheet member 6 are bonded via this sacrifice layer 8. The sacrifice layer 8 may be electroconductive or insulative. The sacrifice layer 8 is made up of a resin layer to which Ti and electroconductive fillers are mixed, for example.

As illustrated in FIG. 1, each contact member 5 includes the leg portion 5*b* extending in one direction from the fixed portion 5*a*, and the leg portion 5*b* bends downward with respect to the height position of the fixed portion 5*a*. In other words, the leg portion 5*b* bends in the direction away from the electronic part 2 (in the surface direction of the opposite side of the bonding surface of the fixed portion 5*a* as to the electronic part 2).

The leg portion 5*b* has elastic deformation in a curved shape such as shown in FIG. 1 due to internal stress. Different internal stress is applied to the inside of the leg portion as described later in the manufacturing method. More specifically, compressive stress is applied to the under surface side of the leg portion 5*b*, and on the other hand, tensile stress is applied to the top surface side of the leg portion 5*b*. Consequently, the leg portion 5*b* is bent and deformed downward in the manner of a cantilever. As illustrated in FIG. 1, through holes 10 are formed in the sheet member 6 each of which is formed in a position facing part of the leg portion 5*b*, the part of the leg portion 5*b* is bent so as to enter the through hole 10, a tip 5*b*1 of the leg portion 5*b* protrudes downward from the through hole 10, and the protruding tip 5*b*1 is electrically connected on a predetermined wiring pattern provided on the board 1. That is to say, with the embodiment in FIG. 1, the tip 5*b*1 serves as a contact point.

As illustrated in FIG. 2, it is preferable that the leg portion 5*b* is bent and deformed so as to assume a general U-shape in the lower direction, and a bonding surface 15 to be bonded together with the terminal 2*a* of the fixed portion 5*a* comes into contact with on the board 1 so as to electrically connect to the wiring pattern on the board 1, thereby expanding the contact area between the leg portion 5*b* and the board 1, and ensuring electroconductive connection between the electronic part 2 and the board 1.

According to the embodiment illustrated in FIGS. 1 and 2, the terminal 2*a* of the electronic part 2 is electroconductively connected to the board 1 via the leg portion 5*b* of the contact member 5. Providing the contact structure 3 thus configured on the lower side of the terminal 2*a* can ensure electrical connectivity between the board 1 and the electronic part 2.

Even if the height dimension between the terminal 2*a* and the board 1 is somewhat deviated at the time of electroconductively connecting the electronic part 2 on the board 1, the contract member 5 bent and deformed downward has elastic force, so the leg portion 5*b* of the contact member 5 is elastically deformed due to the elastic force when the tip 5*b*1 of the contact member 5 comes into contact with a certain wiring pattern on the board 1, thereby electrically connecting the contact member 5 on the wiring pattern of the board 1 in a reliable manner.

Now, description will be made regarding dimensions. A pitch T1 between the adjacent contact members 5 (see FIG. 1) is 20 to 500 μm or so. An amount-of-protrusion δ from the sheet member 6 of the contact member 5 (see FIG. 1) is 10 to 100 μm or so. Also an all-over length of the leg portion 5*b* (see FIG. 1) is 50 to 1000 μm or so.

The amount of protrusion δ of the contact member 5 is set to so as to set the stress necessary for distorting the tip 5*b*1 of the leg portion 5*b* to the same surface as the under surface of the sheet member 6 (the surface of the sheet member 6 facing the board 1 side facing the electronic part 2 to which the fixed portion 5*a* of the contact member 5 is fixed) smaller than a yield point. Consequently, even if the tip 5*b*1 of the leg portion 5*b* is bent to the same surface as the under surface 6*b* of the sheet member 6 due to impact and so forth, the impact is absorbed, and when a gap is provided between the sheet member 6 and the board 1, the leg portion 5*b* elastically deforms downward while keeping a state in which the leg portion 5*b* is in contact with on the board 1 as illustrated in FIG. 1 (restores to the state in FIG. 1), and accordingly, the leg portion 5*b* appropriately serves as an elastic contact point.

The arrangement shown in FIG. 3 is a second embodiment according to the present invention, wherein the contact structure 3 illustrated in FIG. 1 is provided on the board 1 side. The contact structure 3 illustrated in FIG. 1 is disposed upside down so that the tip 5*b*1 of the leg portion 5*b* of the contact member 5 can face the upward direction, and the under surface (bonding surface) of the fixed portion 5*a* of the contact member 5 and the wiring pattern on the board 1 are bonded using ultrasonic welding, cold welding, electrically conductive adhesive or the like.

As illustrated in FIG. 3, the terminal 2*a* of the electronic part 2 is disposed over the tip 5*b*1 of the contact member 5, the electronic part 2 is in contact with on the contact structure 3 so as to electroconductively connect between the terminal 2*a* and the tip 5*b*1 of the contact member 5.

According to the present invention, the tip 5*b*1 of the contact member 5 of the contact structure 3 attached to the electronic part 2 (or board 1) and the wiring pattern on the board 1 (or the terminal 2*a* of the electronic part 2) are finally fixed each other. However, an arrangement may be made wherein prior to the fixing, the electronic part 2 and the board 1 are electrically tentatively connected via the contact structure 3 as illustrated in FIG. 1 for example, and a desired electrical test is performed in this state. When succeeding in the electrical test, the leg portion 5*b* and the board 1 can be bonded using an electroconductive adhesive agent, or the like. Though not shown in the drawings, a fixing member or the like for appropriately fixing the electronic part 2 on the board 1 may be provided.

As illustrated in FIGS. 1 through 3, through holes 5*b*2 are provided in the leg portion 5*b* of the contact member 5. The through holes 5*b*2 are used during a later-described manufacturing process, and providing the through holes 5*b*2 is preferable for facilitating bending of the leg portion 5*b* in a certain direction utilizing internal stress, but these are not indispensable for the present invention.

The contact member 5 is preferably formed with a thin film using the sputter vapor deposition method, electronic beam vapor deposition method, molecular beam epitaxy method, chemical vapor deposition method, electroless plating method, and so forth. Downsizing and thinning of the contact member 5 can be realized by forming the contact member 5 with a thin film, so the connection configuration between the board 1 and the electronic part 2 can be formed finely as desired.

Note that the contact member 5 is preferably formed using the sputter vapor deposition method. As described in a later-described manufacturing method, the deposition conditions of the contact member 5 need to be controlled so that different internal stress can be applied to the under surface side and top surface side thereof. At this time, the sputter vapor deposition method is preferably employed since this method can readily apply different internal stress to the under surface side and top surface side of the contact member 5 by simply changing vacuum gas pressure.

The contact member 5 is formed of an electroconductive material for securing electrical connectivity between the electronic part 2 and the board 1, and examples of this electroconductive material include NiZr alloy.

The metal film 7 formed on the surface of the contact member 5 serves as a bonding layer as to the terminal 2*a* of the electronic part 2 (or the wiring pattern on the board 1) as described above, and the fixed portion 5*a* of the contact member 5 and the terminal 2*a* (or wiring pattern) can be firmly bonded via the metal film 7 using ultrasonic welding, cold welding, electrically conductive adhesive or the like. Also, the metal film 7 is formed of precious metal such as Au or a Ni film, which are excellent in electrical conductance, so electrical connectivity between the electronic part 2 and the board 1 can be improved, and also electroconductive deterioration due to rust and so forth can be prevented.

With the present invention, as described above, internal stress is applied to the contact member 5, and the leg portion 5*b* of the contact member 5 is bent and deformed in a certain direction utilizing the internal stress.

In FIG. 1, the under surface side on which the terminal 2*a* of the electronic part 2 is formed is the mounting surface as to the board 1, but providing the contact structure 3 and the contact member 5 having the leg portion 5*b* bent in the direction of the board 1 on this mounting surface allows electroconductive connection between the terminal 2*a* of the electronic part 2 and the wiring pattern on the board 1 to be performed via the contact member 5 in a simple and reliable manner. With the present invention, the contact member 5 having the leg portion 5*b*, which serves as an elastic contact point, bent and deformed, is provided between the electronic part 2 and the board 1, and accordingly, even if there are great differences between the electronic part 2 and the board 1 in thermal expansion coefficients, the leg portion 5*b* of the contact member 5 having elastic force can absorb distortion due to the thermal expansion coefficient differences, and thus, electroconductive connection between the electronic part 2 and the board 1 in a reliable manner. With the present invention, it is preferable that the sheet member 6 is provided as illustrated in FIGS. 1 through 3, the through hole 10 is provided in the sheet member 6, part of the leg portion 5*b* passes through the through hole 10, and the tip 5*b*1 of the leg portion 5*b* protrudes from the surface opposite to the surface on which the contact member 5 of the sheet member 6 is bonded. With the present invention, the contact members 5 corresponding to the number of the terminals 2*a* of the electronic part 2 are attached to the sheet member 6, the fixed portion 5*a* of the multiple contact member 5 can be bonded simultaneously underneath of the terminals 2*a* of the electronic part 2 (or on the wiring patterns of the board 1). With the conventional arrangement, each spring member has been independently bonded underneath of the terminal 2*a* of the electronic part 2. However, with the present invention, the contact members 5 corresponding to the number of the terminals 2*a* of the electronic part 2 are attached to the sheet member 6, so the multiple contact members 5 can be bonded underneath of the terminals 2*a* simultaneously using ultrasonic welding, cold welding, electrically conductive adhesive or the like by disposing the sheet member 6 underneath of the terminals 2*a* of the electronic part 2.

The tip 5*b*1 of the leg portion 5*b* of the contact member 5 preferably passes through the through hole 10 of the sheet member 6, and protrudes downward from the under surface of the sheet member 6 as illustrated in FIG. 1, for example. Thus, the tip 5*b*1 of the contact member 5 protrudes from the under surface of the sheet member 6 to the mounting surface of the electronic part 2 as to the board 1, thereby facilitating electroconductive connection as to the board 1. Also, for example, in FIG. 1, the sheet member 6 intervenes between the contact member 5 and the board 1, and only part of the leg portion 5*b* of the contact member 5 exposes from the sheet member 6, so even if the electronic part 2 is strongly pressed in the direction of the board 1, or the amount of protrusion of the tip 5*b*1 of the leg portion 5*b* is extremely small, the fixed portion 5*a* of the contact member 5 and the like are not in contact with on the board 1 owing to the insulating sheet member 6. Thus, a configuration having a highly reliable contact point can be provided.

Also, for example, in FIG. 1, in the event that part of the leg portion 5*b* of the contact member 5 extends to at least the through hole 10 and the part of the leg portion 5*b* can be viewed from the board 1 side, even if the part of the leg portion 5*b* does not protrude downward from the under surface of the sheet member 6 through the through hole 10, the wiring pattern on the board 1 and the part of the leg portion 5*b* can be electroconductively connected using an electroconductive adhesive agent. However, the case in which the tip 5*b*1 of the contact member 5 protrudes downward from the under surface of the sheet member 6 is preferable in that an electrical test can be performed prior to bond, and electroconductive connection between the electronic part 2 and the board 1 can be ensured, as described above.

With the present invention, the contact member 5 is formed using a thin-film technique, and even if the contact member 5 is micro-fabricated according to the size of the ultra-fine electronic part 2, the leg portion 5*b* of the contact member 5 can be bent and deformed in an appropriate and simple manner, and thus, an elastic contact point can be appropriately formed between the electronic part 2 and the board 1.

Note that the contact member 5 is not restricted to the cantilever shapes illustrated in FIGS. 1 through 3, and may be a helical shape or the like as viewed from above. Description will be made regarding this arrangement, which is the third embodiment of the present invention, with reference to FIG. 4.

In FIG. 4, a fixed portion 35*a* of a contact member 35 is bonded on a surface 6*a* of the sheet member 6, a leg portion 35*b* formed integrating with the fixed portion 35*a* is formed protruding downward through the through hole 10 formed in the sheet member 6 from a winding leading end 35*b*1 to a winding trailing end (tip) 35*b*2 in a helical manner. As illustrated in FIG. 4, the tip 35*b*2 of the leg portion 35*b* of the first contact member 35 is electroconductively connected on a wiring pattern on the board 1.

With the embodiment illustrated in FIG. 4, the leg portion 35*b* of the contact member 35 is formed protruding in a helical manner, and electroconductive connection between the board 1 and the electronic part 2 can be ensured by the leg portion 35*b* serving as an elastic contact point bending vertically.

The contact member 35 illustrated in FIG. 4 is not a member bent and deformed utilizing internal stress unlike the contact members illustrated in FIGS. 1 through 3 but a member three-dimensionally formed using a tool.

In FIG. 4, the fixed portion 35*a* of the contact member 35 and the sheet member 6 are bonded via an electroconductive adhesive agent (not shown), for example. Also, the contact member 35 is formed of a foil material such as a copper foil for example, and the metal film 7 illustrated in FIG. 1 is formed around the foil substance using the sputter method, plating method, or the like. The metal film 7 preferably has a laminated structure made up of a layer principally formed of Ni for improving spring properties, and an electroconductive layer such as Au for improving electrical conductance.

Description will be made below regarding the manufacturing method of the contact structure 3, illustrated in FIG. 1, with reference to FIGS. 5 through 14. Each diagram is a partial cross-sectional diagram of the contact structure 3 during a manufacturing process (though only FIG. 14 includes a cross-sectional diagram of the electronic part 2).

Figure 5:
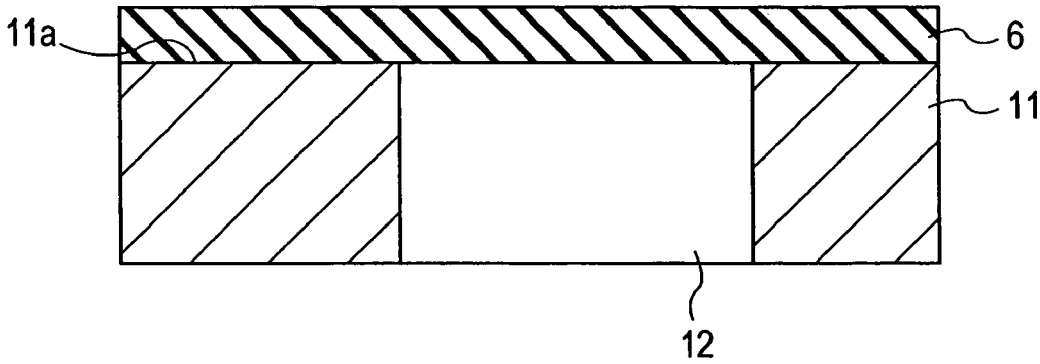
FIG. 5 is a partial enlarged cross-sectional diagram illustrating the manufacturing method of the contact structure shown in FIG. 1.

In FIG. 5, the sheet member 6 is adhered on a surface 11*a* of a base 11. The base 11 is formed of copper foil, for example. A through hole 12 is formed in the base 11 beforehand. The through hole 12 is for forming the through hole 10 illustrated in FIG. 1 as to the sheet member 6 for example, and the through holes 12 corresponding to the desirable number and positions of the through holes 10 to be provided on the sheet member 6, are formed on the base 11. The sheet member 6 is a resin sheet formed of polyimide or the like, for example. Note that though not illustrated in the drawings, a peeling layer formed of a thermal plastic resin or the like for example may be formed on the surface 11*a* of the base 11.

Figure 6:
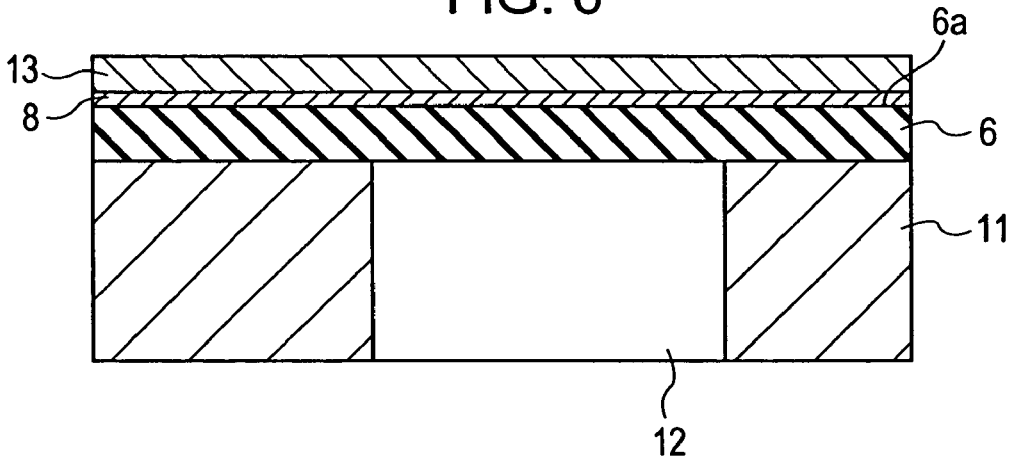
FIG. 6 is a partial enlarged cross-sectional diagram of a process to be performed following that shown in FIG. 5.

As illustrated in FIG. 6, a sacrifice layer 8 is formed on the entire surface 6*a* of the sheet member 6. The sacrifice layer 8 may be an electroconductive material or insulating material. The sacrifice layer 8 is formed of a resin layer in which Ti and electroconductive fillers are mixed, for example.

In the process illustrated in FIG. 6, an electroconductive layer 13 serving as the contact member 5 is formed on the entire surface of the sacrifice layer 8 using the sputter vapor deposition method, for example. More specifically, the electroconductive layer 13 is made up of NiZr alloy (Ni of 1 atomic percent is added), MoCr, or the like.

When the electroconductive layer 13 is formed using the sputter vapor deposition method, the sputter film formation of the electroconductive layer 13 is performed while gradually changing vacuum gas pressure (Ar gas, for example), and compressive stress is applied to the under surface side of the electroconductive layer 13 and tensile stress to the top surface thereof.

Figure 7:
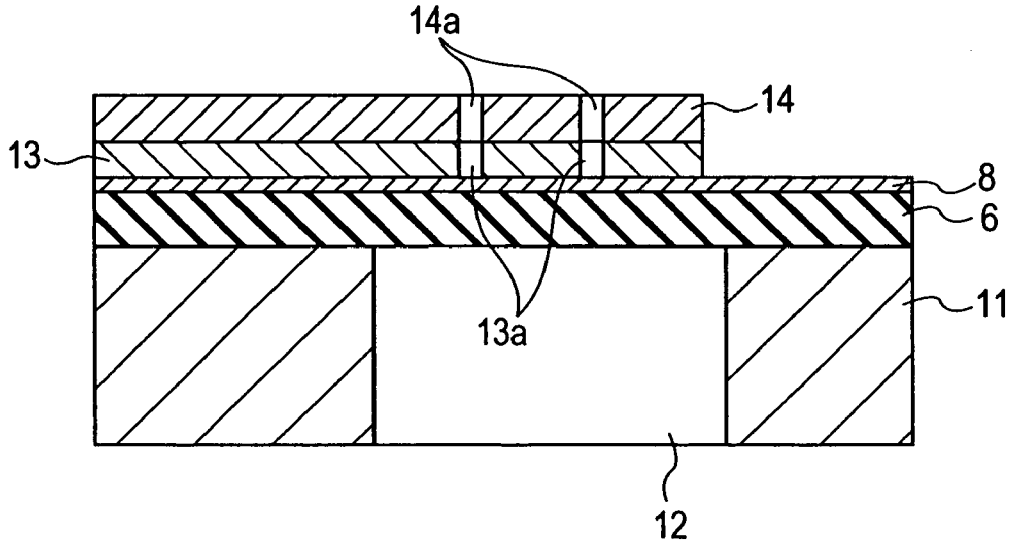
FIG. 7 is a partial enlarged cross-sectional diagram of a process to be performed following that shown in FIG. 6.

In the process illustrated in FIG. 7, a mask layer 14 such as a resist is formed on the electroconductive layer 13. First, the mask layer 14 is coated on the entire surface of the electroconductive layer 13 using spin coat or the like, and is subjected to patterning in the same shape as the contact member 5 due to an exposure phenomenon. Two through holes 14*a* are formed in the mask layer 14 subjected to patterning, as illustrated in FIG. 7. The two through holes 14*a* are also formed due to an exposure phenomenon.

In the process illustrated in FIG. 7, the electroconductive layer 13 not covered with the mask layer 14 is removed using the etching method. Examples of the available etching methods include ion milling, reactive ion etching, and plasma etching. According to this etching process, the electroconductive layer 13 remains in the same shape as the contact member 5. In this etching process, through holes 13*a* are also formed in the electroconductive layer 13 by etching from the through holes 14*a* formed in the mask layer 14. Note that in the following processes, description will be made wherein the electroconductive layer 13 left in the process illustrated in FIG. 7 is referred to as the contact member 5, and the through holes 13*a* are referred to as the through holes 5*b*2 in order to match the names and reference characters with those in FIGS. 1 thorough 3.

Figure 8:
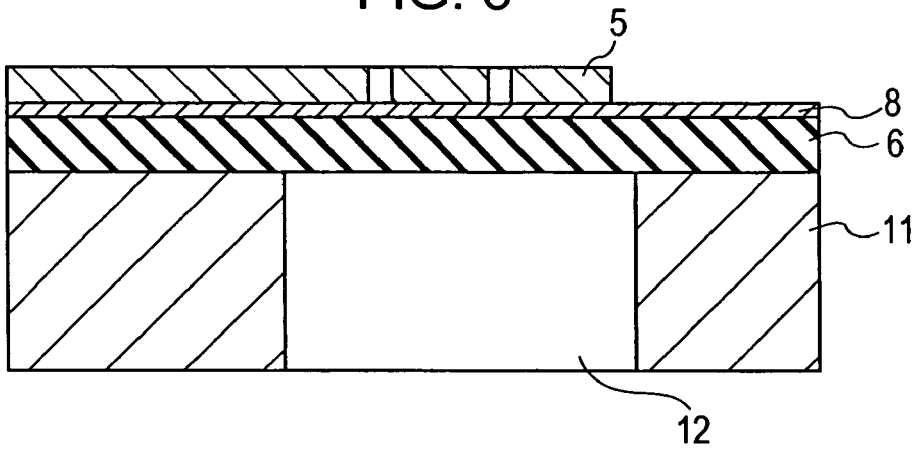
FIG. 8 is a partial enlarged cross-sectional diagram of a process to be performed following that shown in FIG. 7.

In the process illustrated in FIG. 8, the mask layer 14 formed of the resist or the like is removed by dipping this into a dissolving solution or the like.

Figure 9:
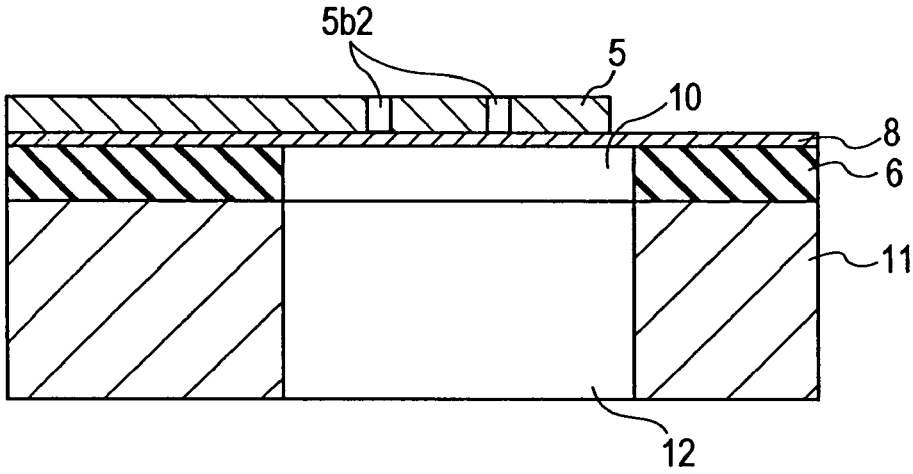
FIG. 9 is a partial enlarged cross-sectional diagram of a process to be performed following that shown in FIG. 8.

In the process illustrated in FIG. 9, the through hole 10 is formed on the sheet member 6 from the through hole 12 by the etching method, laser beam machining, or the like. In the etching process, selective etching is employed, so only the sheet member 6 is subjected to etching selectively so as to form the through hole 10. As described above, forming the through hole 10 using etching or laser beam machining can reduce the width of the through hole 10 to between 10 and 20 μm, in a fine and high-precision manner.

Figure 10:
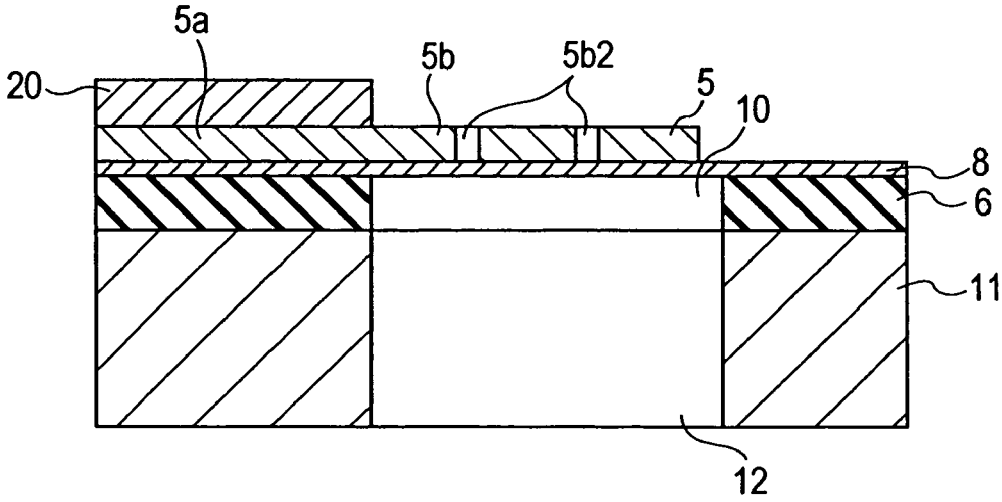
FIG. 10 is a partial enlarged cross-sectional diagram of a process to be performed following that shown in FIG. 9.

In the process illustrated in FIG. 10, a mask layer 20 is formed on a position to become the fixed portion 5*a* of the contact member 5. The mask layer 20 is formed of a resist or the like. Subsequently, part of the sacrifice layer 8 not covered with the mask layer 20 is removed using the wet etching method for example. The sacrifice layer 8 is formed on the entire surface of the sheet member 6 prior to the wet etching process illustrated in FIG. 10. The part of the sacrifice layer 8, which is not covered with the mask layer 20, and also spreads around the contact member 5, is removed. At the same time, part of the sacrifice layer 8, which is positioned underneath of the leg portion 5*b* of the contact member 5, is also removed, by wet etching. With the wet etching method, the etching solution reaches the sacrifice layer 8 positioned underneath of the leg portion 5*b* from the through hole 5*b*2 and due to wraparound of the etching solution from around the leg portion 5*b*, thereby appropriately dissolving the sacrifice layer 8 under the leg portion 5*b*.

Figure 11:
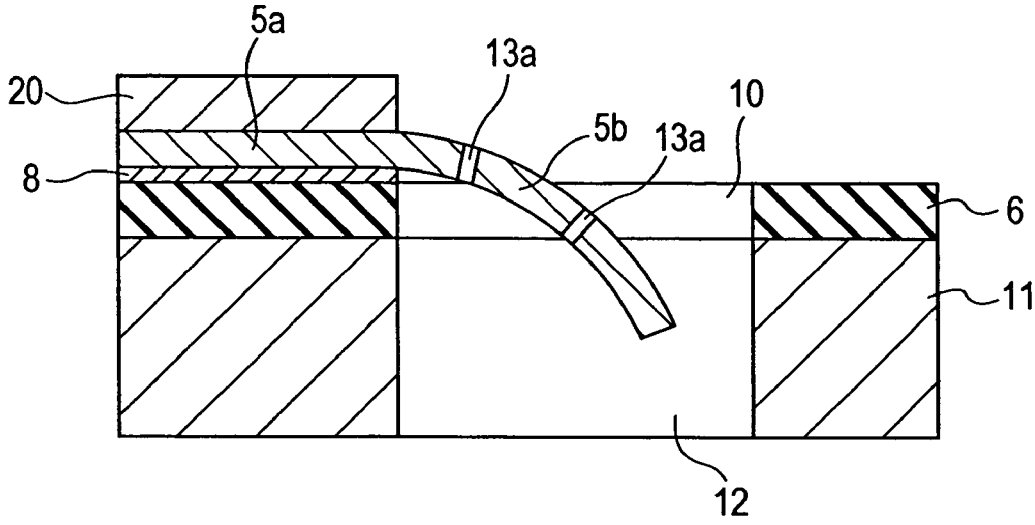
FIG. 11 is a partial enlarged cross-sectional diagram of a process to be performed following that shown in FIG. 10.

As illustrated in FIG. 11, the sacrifice layer 8 remains only on the underside of the fixed portion 5*a* of the contact member 5. Upon the sacrifice layer 8 on the underside of the leg portion 5*b* being removed, the leg portion 5*b* causes elastic deformation in accordance with internal stress (state in FIG. 11).

As described in the process illustrated in FIG. 9, compressive stress is applied to the under surface side of the contact member 5 (electroconductive layer 13), and tensile stress to the top surface side thereof, so that the leg portion 5*b*, of which upward-suppression and downward-suppression have been removed, is elastically deformed downward in a curved shape. At this time, the leg portion 5*b* enters the through holes 10 and 12 provided on the sheet member 6 and the base 11, so the elastic deformation of the leg portion 5*b* cannot be inhibited.

Figure 12:
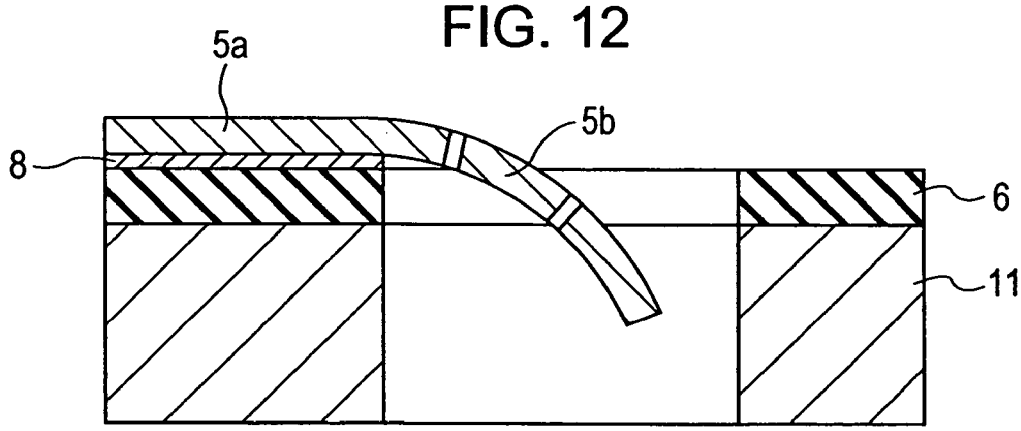
FIG. 12 is a partial enlarged cross-sectional diagram of a process to be performed following that shown in FIG. 11.

In the process illustrated in FIG. 12, the mask layer 20 is removed. If the mask layer 20 is a resist, the mask layer 20 is dipped into a dissolved solution so as to be removed. Even after the mask layer 20 is removed, the fixed portion 5*a* of the contact member 5 remains firmly bonded to the sheet member 6 by the sacrifice layer 8.

Figure 13:
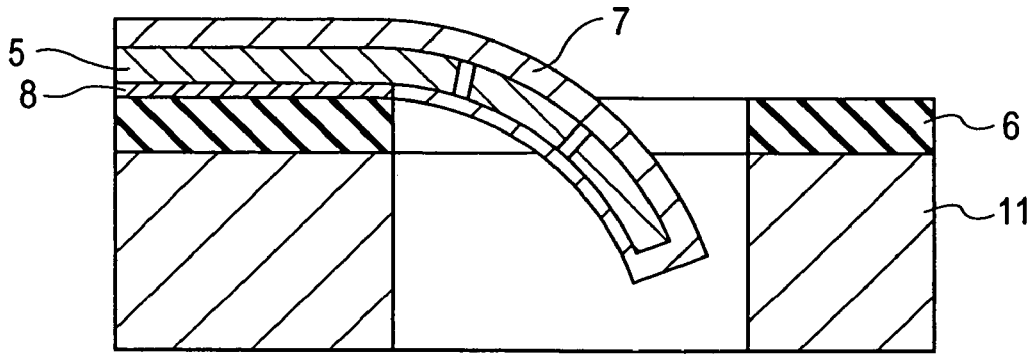
FIG. 13 is a partial enlarged cross-sectional diagram of a process to be performed following that shown in FIG. 12.

In the process illustrated in FIG. 13, the entire exposing surface of the contact member 5 is plated with the metal film 7 such as precious metal (Au or the like) or Ni using the electroless plating method or the like.

The under surface of the fixed portion 5*a* of the contact member 5 is bonded with the sheet member 8 via the sacrifice layer 8, so the under surface of the fixed portion 5*a* is not exposed, and accordingly, the entire surface of the contact member 5 except for the under surface of the fixed portion 5*a* is covered with the metal film 7. Though formation of the metal film 7 is not indispensable, the metal film 7 is preferably formed in that electroconductive deterioration due to the rust of the contact member 5 or the like can be suppressed, and also in that electroconductive connection between the board 1 and the electronic part 2 can be improved. In addition, as described in the next process, bonding to the terminal 2*a* of the electronic part 2 can be improved. The configuration of the contact structure 3 illustrated in FIGS. 1 through 3 is complete in the process illustrated in FIG. 13.

Figure 14:
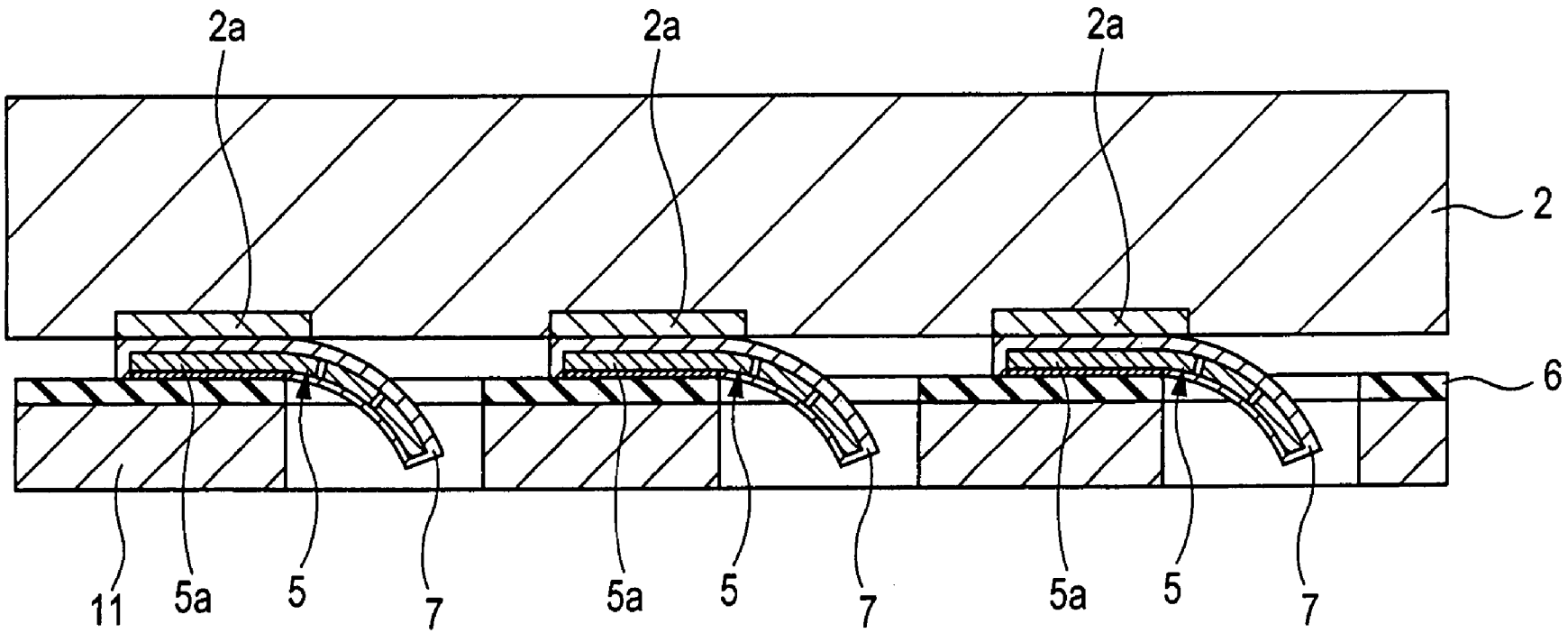
FIG. 14 is a partial cross-sectional diagram illustrating a process for attaching the contact structure formed to the electronic part.

In the process illustrated in FIG. 14, the terminal 2*a* formed in the electronic part 2 such as an IC, comes into contact with the surface opposite to the surface to which the sheet member 6 of the fixed portion 5*a* of the contact member 5 is attached (top surface, i.e., bonding surface in FIG. 14), and the fixed portion 5*a* of the contact member 5 is bonded with the terminal 2*a* using ultrasonic welding, cold welding, electrically conductive adhesive or the like, for example.

In the process illustrated in FIG. 14, the metal film 7 formed in the process illustrated in FIG. 13 can serve as a bonding layer, so the fixed portion 5*a* of the contact member 5 can be bonded with the terminal 2*a* using ultrasonic welding, cold welding or electrically conductive adhesive for example. That is to say, the fixed portion 5*a* of the contact member 5 can be simply bonded with the terminal 2*a* without employing an electroconductive adhesive agent or the like, thereby simplifying the manufacturing process.

In the process illustrated in FIG. 14, the base 11 is removed following the contact member 5 being bonded underneath of the terminal 2*a*. Though the etching method may be employed as a method for removing the base 11, providing a peeling layer between the base 11 and the sheet member 6 in the process illustrated in FIG. 5 beforehand allows the base 11 to be readily removed from the peeling layer, and also allows the peeled base 11 to be reused, thereby suppressing increase in manufacturing costs.

Note that the leg portion 5*b* of the contact member 5 may be subjected to thermal processing during the process illustrated in FIG. 11 through the process illustrated in FIG. 13, i.e., prior to attaching the electronic part 2. The internal stress within the leg portion 5*b* of the contact member 5 is increased by this thermal processing, and the leg portion 5*b* can be readily elastically deformed in a curved shape, and consequently, the leg portion 5*b* can be curve-deformed to the general U-shaped form such as illustrated in FIG. 2.

The present invention exhibits distinctive characteristics in that different internal stress is applied to the under surface side and top surface side of the contact member 5 (electroconductive layer 13) in the process illustrated in FIG. 6, and in that the sacrifice layer 8 underneath of the leg portion 5*b* of the contact member 5 is removed in the process illustrated in FIG. 10, and so forth.

The aforementioned processes allow the leg portion 5*b* to be bent and deformed downward utilizing internal stress such as illustrated in FIG. 11. In addition, with the present invention, the top surface of the fixed portion 5*a* of the contact member 5, which is not bent and deformed, can be employed as a bonding surface with the terminal 2*a* of the electronic part 2, and particularly, forming the metal film 7 in the process illustrated in FIG. 13 allows the metal film 7 to be used as a bonding layer, so that the terminal 2*a* of the electronic part 2 and the fixed portion 5*a* of the contact member 5 can be readily bonded using ultrasonic welding, cold welding, electrically conductive adhesive or the like, for example.

Also, it is preferable that the multiple contact members 5 formed corresponding to the number of the terminals 2*a* of the electronic part 2 and the interval between the adjacent terminals 2*a* can be fixed and retained on the sheet member 6, so in the process illustrated in FIG. 14, the fixed portions 5*a* of the multiple contact members 5 can be simultaneously bonded underneath of the terminals 2*a* of the electronic part 2, thereby simplifying the manufacturing process. Also, the multiple contact members 5 are attached to the sheet-shaped sheet member 6, so the respective contact members 5 are not scattered about prior to bonding with the electronic part 2, and also transportation and the like of the sheet members 6 can be readily performed.

The base 11 in the process illustrated in FIG. 5 is not indispensable, but the base 11 is preferably employed for facilitating the manufacturing process. The through hole 10 is formed in the sheet member 6 in the process illustrated in FIG. 9, but utilizing the through hole 12 formed in the base 11 allows the through hole 10 to be formed in the sheet member 6 in a simple and reliable manner, and also mounting the flexible sheet member 6 on the base 11, which is harder than the sheet member 6, allows the sacrifice layer 8 and the electroconductive layer 13 to be readily formed on the sheet member 6. Note that the through hole 12 is formed in the base 11 beforehand, but the through hole 12 can be formed in any stage by the process illustrated in FIG. 9 (i.e., a preliminary stage for forming the through hole 10 in the sheet member 6). Note that an arrangement may be made wherein the contact structure 3 in the state illustrated in FIG. 13 is inverted, and the contact structure 3 is attached to the board 1 side, as illustrated in FIG. 13.

Figure 15:
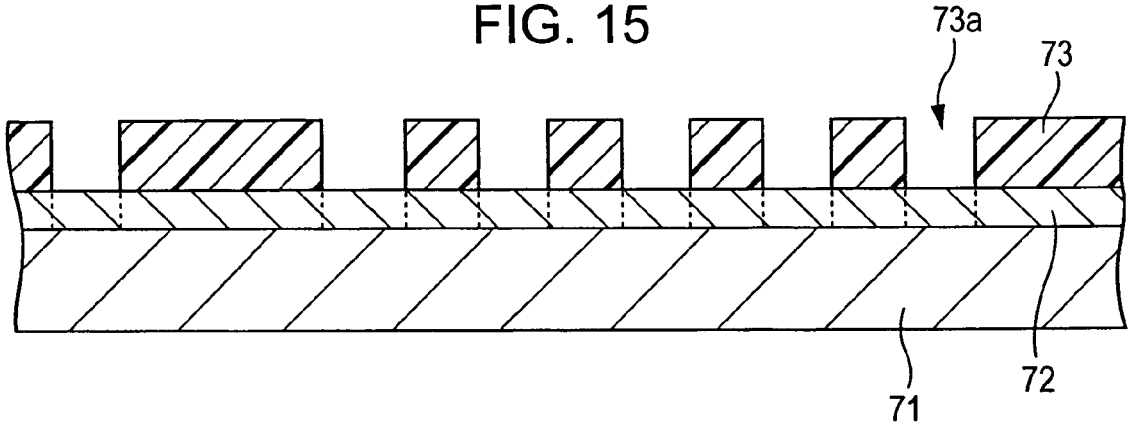
FIG. 15 is a partial cross-sectional diagram describing the manufacturing method of the contact structure shown in FIG. 4.
Figure 16:
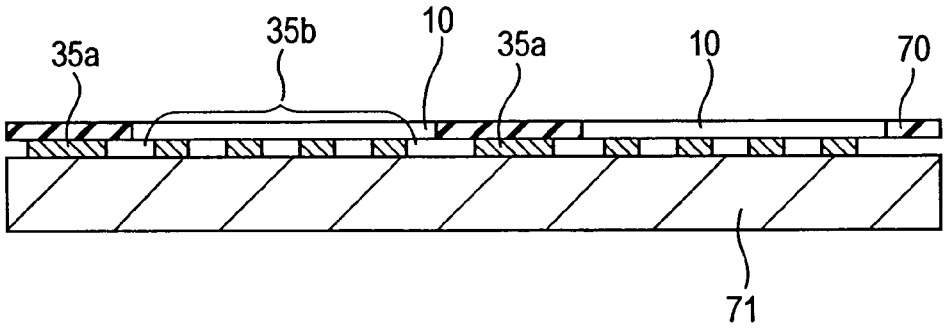
FIG. 16 is a partial cross-sectional diagram of a process to be performed following that shown in FIG. 15.
Figure 17:
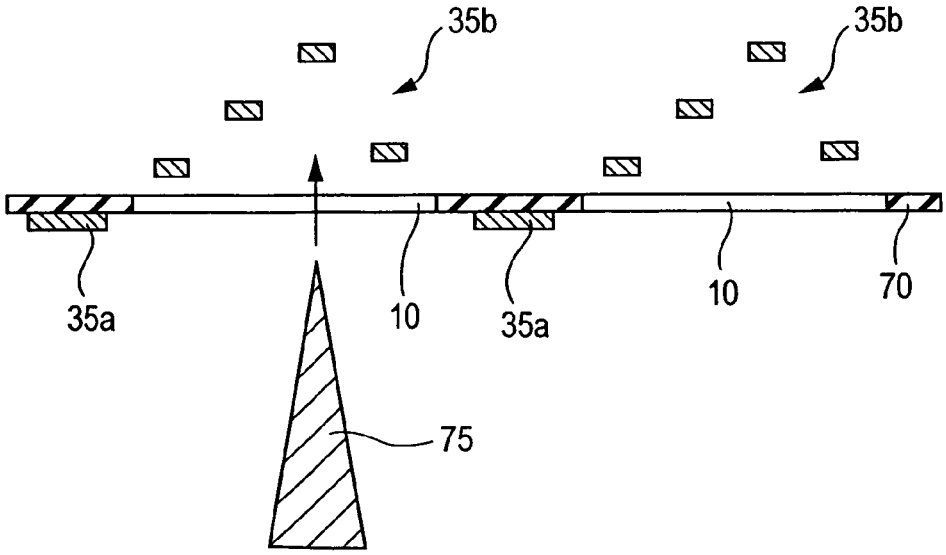
FIG. 17 is a partial cross-sectional diagram of a process to be performed following that shown in FIG. 16.

FIGS. 15 through 17 are partial cross-sectional diagrams of the contact structure 3 illustrated in FIG. 4 during the manufacturing process. As illustrated in FIG. 15, for example, a copper foil 72 is provided on a base 71, and a resist layer 73 is coated on the copper foil 72. The resist layer 73 is left in the same shape as a contact member 35 due to an exposure phenomenon, and an extracted pattern 73*a* is formed in the portions other than this shape of the resist layer 73. Next, the copper foil 72 exposed from the extracted pattern 73*a* is removed by etching or the like. Thus, the contact member 35 made up of the copper foil 72 is complete.

The contact member 35 comprises a fixed portion 35*a* and a leg portion 35*b* formed in a helical manner as illustrated in FIG. 16. The fixed portion 35*a* and the leg portion 35*b* are formed in a flat manner, and in the state illustrated in FIG. 16, the sheet member 70 is adhered on the fixed portion 35*a* of the contact member 35 through an electroconductive adhesive agent or the like (not shown).

As illustrated in FIG. 16, the through hole 10 is formed in the sheet member 70 beforehand. The size of the through hole 10 is greater than the perimeter of the leg portion 35*b*.

Next, the base 71 is removed. Now, good spring properties and electrical conductance are required for the contact member 35, so following the base 71 being removed, for example, an auxiliary elastic layer excellent in spring properties, such as Ni, or an electroconductive layer excellent in electrical conductance, such as Au, is preferably plated around the contact members 35 and 36 made up of a copper foil using the electroless plating method or the like.

Next, when a protrusion adjusting member 75 having a sharp tip is passed through the through hole 10 and moved upward, the helical-shaped leg portion 35*b* positioned facing the through hole 10 is bent upward by the protrusion adjusting member 75 pushing upward, and the helical-shaped leg portion 35*b* protrudes upward, as illustrated in FIG. 17.

Thus, following the contact member 35 being formed on the sheet member 70, in the state illustrated in FIG. 17, the sheet member 70 inverted, the fixed portion 35*a* is disposed over the sheet member 70, and the fixed portion 35*a* is bonded underneath of the terminal 2*a* of the electronic part 2 as shown in FIG. 4. At this time, the fixed portion 35*a* and the terminal 2*a* may be bonded using an electroconductive adhesive agent or the like, but a metal film such as Au formed of plate or the like is exposed on the surface of the fixed portion 35*a* of the contact member 35, and accordingly, the fixed portion 35*a* and the terminal 2*a* of the electronic part 2 may be bonded by ultrasonic welding, cold welding or electrically conductive adhesive.

Description has been made regarding a contact structure to be used between an electronic part such as an IC, and a board; however, the contact structure may be employed between electronic parts. The configuration according to the present invention may be applied to a contact structure to be employed between electronic members in a broad sense including electronic parts, boards, and the like.

What is claimed is:

1. A contact structure for electroconductively connecting between two electronic members, a contact member thereof comprising:

a fixed portion to be fixed to a fixing face on one of said electronic members; and a leg portion for electroconductively connecting between said electronic members, said leg portion being continuous from said fixed portion and extending from said fixed portion to the other one of said electronic members, wherein said leg portion is deformed in a direction away from said fixing face and toward said other one of said electronic members, and said leg portion of said contact member has a shape protruding as a helix; a sheet member is provided in a gap between the contact member and said other one of said electronic members, and a through hole is provided in said sheet member, a part of said leg portion extending through said through hole towards the other one of said electronic members, such that, when viewed from the direction of the other one of said electronic members, surfaces of the helix facing the one electronic member do not overlap each other.

2. The contact structure according to claim 1, wherein a tip of said leg portion protrudes from said through hole.

3. The contact structure according to claim 1, wherein said contact member includes a thin film.

4. An electronic component to which the contact structure according to claim 1 is attached.

5. The assembly according to claim 4, wherein said fixed portion of said contact structure and said electronic member are bonded by one of ultrasonic welding, cold welding, and electrically conductive adhesive.

* * * * *